United States Patent [19]

Gray

[11] 4,424,489

[45] Jan. 3, 1984

[54] ENGINE ELECTRICAL SYSTEM TEST DEVICE

[76] Inventor: Richard W. Gray, Box 211B, Howe, Ind. 46746

[21] Appl. No.: 302,272

[22] Filed: Sep. 15, 1981

[51] Int. Cl.[3] ..... F02P 17/00

[52] U.S. Cl. ..... 324/396; 324/388

[58] Field of Search ..... 324/396, 397, 388, 395

[56] References Cited

U.S. PATENT DOCUMENTS

| | | | |
|---|---|---|---|
| 1,369,025 | 2/1921 | Hawley et al. | 324/396 X |
| 1,423,204 | 7/1922 | Freeman | 324/396 |
| 1,650,546 | 11/1927 | Strahan | 324/396 X |
| 3,806,796 | 4/1974 | Goldstein | 324/397 X |
| 3,979,664 | 9/1976 | Harris | 324/397 |
| 4,160,203 | 7/1979 | Volk | 324/396 |

FOREIGN PATENT DOCUMENTS

| | | | |
|---|---|---|---|
| 348506 | 2/1922 | Fed. Rep. of Germany | 324/396 |
| 543451 | 6/1922 | France | 324/396 |
| 549119 | 11/1922 | France | 324/396 |

*Primary Examiner*—Stanley T. Krawczewicz

*Attorney, Agent, or Firm*—Flynn, Thiel, Boutell & Tanis

[57] ABSTRACT

A spark ignition engine tester for inserting between pairs of normally interconnected releasable connectors in the high voltage portion of the engine's spark ignition system, as between a spark plug terminal and the corresponding wire from the distributor, and between the high voltage output terminal of the coil and the wire to the distributor. The tester includes first and second electrodes with adjacent ends separated by a visible spark gap and remote ends for connection to the ignition system high voltage portion. An insulator supports the two electrodes substantially at right angles to each other. A conductive coil spring sleeved over the remote end of an electrode inserts into or sleeves over the opposed releasable connector of the emission system high voltage portion.

4 Claims, 6 Drawing Figures

34
36
12A
37
28
19
12B
12
31
G
32
13
II
II
13B
20
10
29
42
41
15
18

27
25
26
α
A
31

12
28
23
19
20

61
64
W
WC
63
12A
28
10
12
G
13
V
13A
15

51
53
52

SP
H
E
CC
68
69
71
48
46
47
A
P
A
31
13A
10
G
12A
67
15
66
C

ENGINE ELECTRICAL SYSTEM TEST DEVICE

FIELD OF THE INVENTION

This invention relates to an engine electrical system test device, and more particularly to a device incorporating a spark gap for interposition in a high voltage current path in a spark engine ignited engine electrical system.

BACKGROUND OF THE INVENTION

Spark gap type test devices for the high voltage side of automotive ignition systems have been known in which electrode elements are spaced by a spark gap and mounted in fixed or substantially fixed relation with respect to each other on an insulator or insulative housing and wherein the tester electrodes have connectors for enabling a spark plug to support the tester which in turn supports the spark plug wire.

However, such existing devices, of which I am aware, have not been entirely satisfactory from the standpoint of fixedly supporting the test device on the spark plug and fixedly locating the spark gap in a constant position despite vibration or movement of the engine, permitting wide angle visibility of the spark gap under crowded engine compartment or disadvantageous light conditions, adaptability to interposition between a variety of connector types commonly found in engine high voltage electrical system portions, at the coil, distributor and spark plug itself, as well as low manufacturing cost, simplicity of construction and minimization of the number of parts and durability in harsh use.

The objects of the present invention include provision of a spark ignition engine testor for overcoming the aforementioned disadvantages.

Other objects and purposes of this invention will be apparent to persons acquainted with apparatus of this general type upon reading the following specification and inspecting the accompanying drawings.

SUMMARY OF THE INVENTION

A spark ignition engine tester insertable between normally interconnected pairs of releasable connectors in the high voltage portion of the engine's spark ignition system. First and second electrodes have adjacent ends spaced by a visible spark gap and remote ends for temporary electrical interposition of the tester between a pair of releasable ignition system connectors. An insulator element fixedly carries the electrodes with the length axes of the latter at right angles to each other. A resilient conductive member is releasably connectible with a remote electrode end and in turn is temporarily connectible to one of the pair of releasable ignition system connectors.

DETAILED DESCRIPTION

Figures 1, 2, 3, 4, 5, 6:
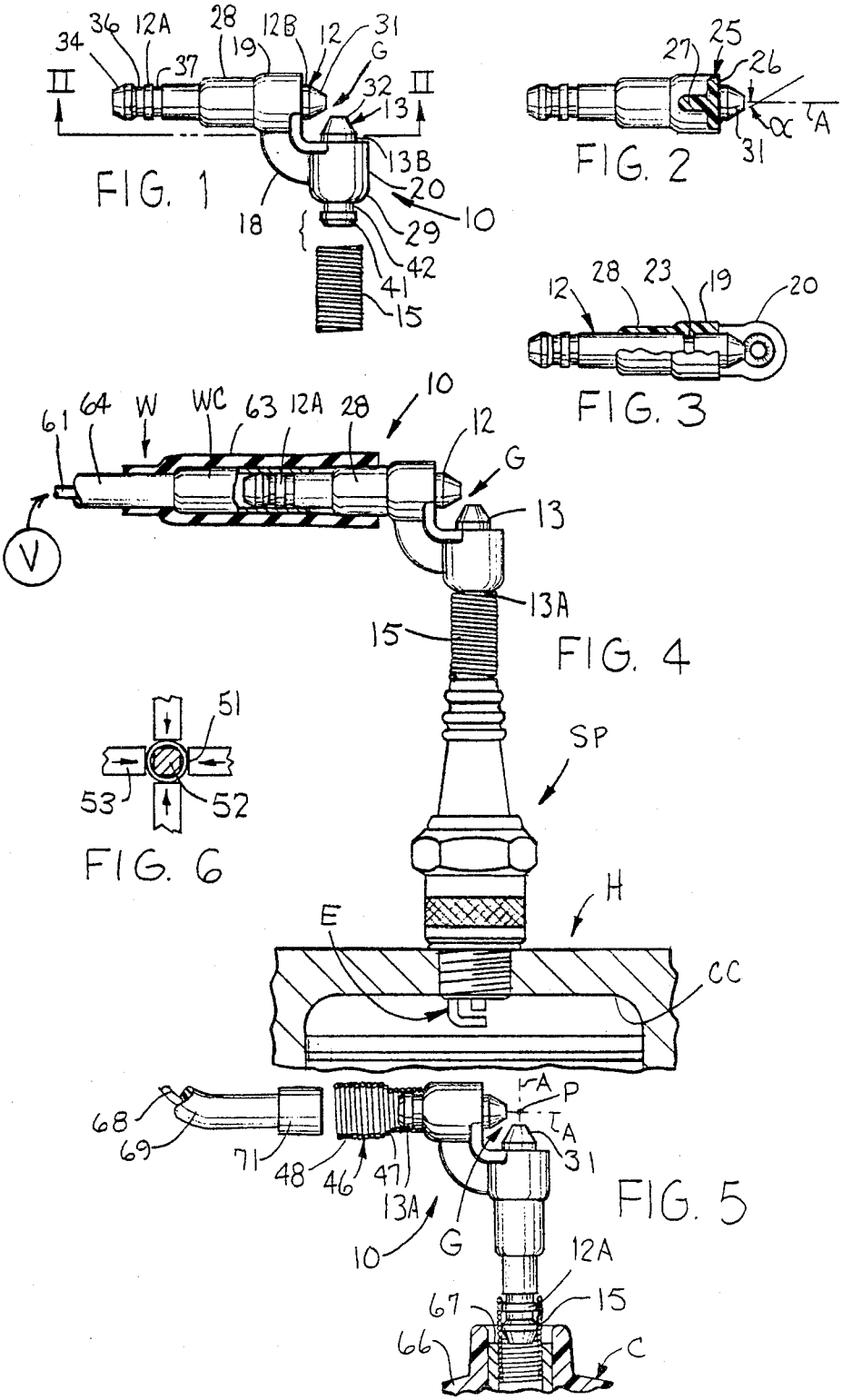
FIG. 1 is a side elevational view of a tester embodying the invention.
FIG. 2 is a sectional view substantially taken on the line II—II of FIG. 1.
FIG. 3 is a partially broken top view of the device of FIG. 1.
FIG. 4 is a partially broken side elevational view of the FIG. 1 tester as interposed in the high voltage supply connection to a spark plug installed in a spark ignition engine.
FIG. 5 is a partially broken side elevational view of a tester embodying the invention interposed in the connection of the high voltage terminal of the ignition coil to the cable leading to the engine distributor.
FIG. 6 is a diagrammatic view of apparatus 4.

The device 10 embodying the invention (FIG. 1) comprises elongate conductive electrodes 12 and 13 having length axes substantially at right angles to each other and fixed with respect to each other at the free ends of the legs 19 and 20 of a generally L-shaped insulator element 18. The insulator element 18 is molded of an electrically insulative, hardenable plastics material, preferably Nylon.

The electrodes, which are of a conductive metal, preferably aluminum, are molded into the insulator member 18. Each electrode may be grooved, as at 23 in FIG. 3, in the intermediate portion thereof fixed within the molded insulator leg end 19 or 20. The L-shaped intermediate portion of the insulator element 18 is of T-shaped cross section as indicated at 25 in FIG. 2 with a wide web 26 facing the convex side of the L and a central rib 27 extending from the convex side of the L. The leg ends 19 and 20 are formed as cylindrical bosses receiving the respective electrodes 12 and 13 coaxially therethrough and having reduced diameter skirts 28 and 29 extending beyond the rib 27. One skirt (here 28) is longer than the other.

The electrodes 12 and 13 have respective remote ends **12*a* and 13*a* which extend beyond the skirts 28 and 29, respectively, of the insulator element 18, and also have adjacent ends 12*b* and 13*b*, respectively, which extend toward each other from the concave side of L-shaped element 18. The adjacent electrode ends 12*b* and 13*b* are preferably chamfered to provide a frustoconical nose 31 at the tip thereof, such that the frustoconical surfaces of the two adjacent electrode ends define a spark gap G therebetween. In the preferred embodiment shown, the angle $\alpha$ (FIG. 2) subtended by the surface of the frustoconical nose 31 from the axis A of the corresponding electrode is less than 45°, and here about 30°. The minimum spacing between the adjacent electrode ends thus is between the rims 32 formed by the minimum diameter end of the frustoconical nose of each electrode. In the preferred embodiment shown, the electrodes are located on the insulator element 18, such that extensions of the profiles of the frustoconical noses 31 and the length axes A of the electrodes meet substantially at a point P (FIG. 5**).

The remote electrode end **12*a* is longer and differently configured than the remote electrode end 13*a*. More particularly, the remote electrode end 12*a* is shaped preferably substantially identical to and of length equal to or longer than the terminal of a conventional spark plug, the remote electrode end 12*a* being substitutable in place of such a spark plug terminal for ignition system testing, as hereafter discussed. Thus, the remote electrode end 12*a* is provided with a frustoconical nose 34 and a pair of circumferential grooves 36 and 37 (FIG. 1**) in the preferred embodiment shown.

On the other hand, the electrode remote end **13*a* is provided with a rounded or shallow frustoconical nose 41 and a single circumferential groove 42**.

The tester further includes a hollow coil spring 15 wound with coils axially abutting and of internal diameter to fit releasably but sufficiently snugly over either electrode remote end **12*a* and 13*a*** as to prevent unintended separation of the spring from the electrode when the tester is used to interconnect portions of the high voltage system of an engine during operation.

The tester also includes a step spring 46 preferably similar to spring 15 except being stepped in the central portion thereof at 47 such that one end 48 thereof is enlarged to an inside diameter corresponding to the outside diameter of the spring 15 in such a way as to snugly but releasably receive the spring 15 therewithin for purposes appearing hereafter. The springs 15 and 46 are of conventional metal spring material such as spring steel wire preferably, though not necessarily, having a plating of more conductive metal material. In view of the high voltages in the high voltage ignition circuit of a spark ignited engine, such conductive plating is not required. It will be noted that the rounded or frustoconidal shape of the electrode remote ends assist in inserting thereof into the correspondingly sided end of one of the springs 15 or 46 or into a female ignition system connector as hereafter discussed. Further, the grooves in the remote electrode ends provide a degree of mechanical interlock with the coils of the springs and with surface irregularities in ignition system female connectors to assist in maintaining the electrode remote ends 12*a* and 13*a* in firm mechanical and electrical engagement with the corresponding spring or ignition system female connector.

To further assist the gripping of the electrode remote ends by the springs, a portion of each spring near the end thereof may be provided with flattened portions 51 (FIG. 6) at several (here 4) evenly circumferentially spaced locations thereon, as by snugly sliding over a correspondingly flatted mandrel 52 and striking with a correspondingly flat ended tool 53.

The high voltage source (indicated schematically at V) may be a magneto or the like, for example as in small engines having one or a few cylinders and of the type found in lawn mowers and motorbikes. On the other hand, the tester embodying the invention can be used with larger multiple cylinder engines of the type found in automotive vehicles. Often, the connector WC is covered by a resilient insulative sleeve 63, which effectively continues the insulation 64 on the high voltage conductor 61.

For test purposes, the tester 10 is installable as follows. With the connector WC removed from its normal position on the terminal T of the spark plug, the longer electrode remote end 12*a* of tester 10 is inserted into the conductive sleeve WC with the resilient insulator shell 63, if of sufficient length, received over at least a part of the skirt 28 to electrically connect electrode 12 with ignition system conductor 61. The lower end of spring 15 is then installed in telescoping relation over the spark plug terminal T, the upper end of spring 15 being sleeved over the shorter electrode remote end 13*a*. Application of a voltage pulse by the engine voltage source to conductor 61, for the purpose of causing the spark plug SP to emit a spark across its electrodes, will now also cause an additional spark to jump the gap G of the tester 10 in a readily visible manner if the engine ignition system is in proper working order. The spring 15 and electrode 13 hold the tester rigidly with respect to spark plug SP despite engine vibration while permitting the tester 10 to be rotated about the axis of the spark plug SP to reposition same manually, should the user so desire.

The tester 10 may be interposed at other locations in the high voltage system of the engine as seen for example in FIG. 5. In an automotive ignition system provided with a coil C, the latter normally has an insulative casing 66 provided with a conductive female connector 67 for supplying high voltage pulses to a conductor 68. The conductor 68 is in an insulative flexible sheath and provided with a male conductive connector 71 snugly insertable into the female connector 67 of the coil. For test purposes, the male and female connectors 71 and 67 are separated. The spring 15 has one end thereof sleeved over one of the electrode remote ends of the tester 10, preferably the longer remote end 12*a*, and the free end of spring 15 is snugly received in the coil female connector 67. The stepped spring 46 has its small diameter end snugly sleeved over the remaining remote electrode end of the tester 10, preferably the shorter remote end 13*a*. The enlarged diameter end 48 of spring 46 snugly receives therein the male connector 71. Thus, with the ignition system in proper operating condition, a voltage pulse produced by the coil C is transmitted as a spark across spark gap G of tester 10, as a spark, and is applied to conductor 68 which then typically connects either directly in a single cylinder engine, or through a distributor in a multiple cylinder engine, to the spark plug or plugs.

While FIGS. 4 and 5 show two examples of interconnection of the tester 10 in the high voltage ignition circuit of an engine, it will be apparent that the tester may also be interconnected at different locations in such ignition system, for example by interposition between a connector on the engine distributor and the associated conductor 61 leading to a corresponding spark plug SP, or between the distributor center connector and the conductor 68 from the coil C. In any case, the electrode remote ends 12*a* and 13*a* and, if appropriate, the outside of spring 15 may be used as male connectors with the interiors of springs 15 and 46 being used as female connectors, to appropriately complement the particular ignition system connectors to be engaged by the tester 10.

In a preferred embodiment for testing an automotive multicylinder engine, a plurality of testers 10 are used in concert, namely a number of testers 10 equipped as in FIG. 4 with a spring 15, equal in number to the number of cylinders of the engine, and an extra tester 10 equipped for example as in FIG. 5 with springs 46 and 15. In use, each of the FIG. 4 testers 10 is used to connect a corresponding spark plug with its corresponding voltage feed conductor 61 and the FIG. 5 tester 10 is interposed between the voltage output connector 67 of the coil C and conductor 68. If for example the engine will not run, the engine may be turned over with the starter while observing the spark gap G of each tester 10. Proper spark across the gap G is characterized as very sharp, thin and blue (almost white). On the other hand, a yellow spark across gap G tends to indicate internal leakage of the coil (which may occur even if the engine is running well in which case leakage may tend to cause poor starting and excessive gas consumption). On the other hand if sporadic spark is observed at the gaps G, this may indicate corrosion and the need for filing or replacement of the contact points or, if the engine has an electronic ignition, it may indicate a burned out resistor which may soon fail altogether. Alternatively if there is no spark at all across the gap G such may indicate that the points (if present) are not opening or that the solid state ignition system is burned out. Also, if the engine is missing on one or more cylinders but adequate spark appears across all gaps G, the faulty cylinder may be found by using a screw driver or the like to ground the spring 15 or the electrodes at gap G to the engine block, cylinder-by-cylinder, the faulty cylinder being the one wherein such grounding results in no drop in engine rpm. Also, with the engine running, the appearance of a yellow colored spark at the gap G of one of the testers 10 may indicate a leaking spark plug conductor 61 connected at that tester. Also, at the tester 10 connected to the coil C as in FIG. 5, spark gap G should be bright blue and the appearance of a sporadic or yellow spark suggests a bad coil. On the other hand if a spark is present at such gap but not at any of the spark plugs, the problem is likely to be in the distributor.

The fixed but removable securement of the tester 10 to the engine is helpful in testing automotive engines but is particularly helpful in testing of small manually started engines such as lawnmower engines started by a pull cord, since the tester 10 maintains the spark at gap G in a fixed, readily visible position while the operator has both hands free to hold the mower in position, pull the starter cord, and the like.

It will be noted from the foregoing that installation of a tester 10 in the ignition circuit of the engine does not interfere with starting or running of the engine.

While some variation may be tolerated, the width of the gap G is preferably about one sixteenth inch.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a spark ignition engine tester for inserting between normally interconnected pairs of releasable connectors in the high voltage portion of the engine's spark ignition system, the combination comprising:

first and second electrodes having adjacent ends spaced by a visible spark gap and remote ends for temporary electrical interposition of said tester between a said pair of releasable ignition system connectors;

an insulator element fixedly carrying said electrodes intermediate the ends of each electrode, the length axes of said electrodes being at right angles to each other; and a resilient conductive member releasably connectible with a said remote electrode end for in turn effecting temporary connection to one of said pair of releasable ignition system connectors, said insulator element being substantially L-shaped in profile with two legs substantially at right angles to each other, said electrodes extending through respective ones of said legs at right angles thereto, said legs and electrodes being substantially coplanar, said insulator element being a one-piece molded plastic element of T cross section intermediate the remote ends of said legs, the ends of said legs comprising substantially cylindrical bosses receiving said electrodes fixedly therethrough, wherein said spark gap is at the concave side of said L, said insulator element having a rib at the convex side of said L, said bosses extending beyond said rib, one said boss and its corresponding electrode remote end being longer than the other.

2. The apparatus of claim 1, in which one remote electrode end is shorter than the other, the longer remote electrode end being receivable snugly in the conventional spark plug receiving socket of the spark plug wire for a given engine spark plug, the shorter remote electrode end having one end of said hollow spring received thereover, the other of said hollow spring being received on the terminal of said given spark plug.

3. In a spark ignition engine tester for inserting between normally interconnected pairs of releasable connectors in the high voltage portion of the engine's spark ignition system, the combination comprising:

first and second electrodes having adjacent ends spaced by a visible spark gap and remote ends for temporary electrical interposition of said tester between a said pair of releasable ignition system connectors;

an insulator element fixedly carrying said electrodes intermediate the ends of each electrode, the length axes of said electrodes being at right angles to each other; and a resilient conductive member releasably connectible with a said remote electrode end for in turn effecting temporary connection to one of said pair of releasable ignition system connectors, the adjacent ends of said electrodes being frustoconical in shape, at least one of said electrode remote ends being elongate and shaped substantially like a conventional spark plug terminal for receiving thereon a conventional spark plug wire, or the like, connector of the engine, the other said remote end being shorter, in which said shorter remote end has a head of diameter larger than its shank, said resilient conductive member being a coil spring snugly received on said head into abutting relation with said insulator element and with about one-half the length of said spring extending beyond said head.

4. In a spark ignition engine tester for inserting between normally interconnected pairs of releasable connectors in the high voltage portion of the engine's spark ignition system, the combination comprising:

first and second electrodes having adjacent ends spaced by a visible spark gap and remote ends for temporary electrical interposition of said tester between a said pair of releasable ignition system connectors;

an insulator element fixedly carrying said electrodes intermediate the ends of each electrode, the length axes of said electrodes being at right angles to each other; and a resilient conductive member releasably connectible with a said remote electrode end for in turn effecting temporary connection to one of said pair of releasable ignition system connectors, said resilient conductive member being a hollow elongate spring with one end snugly receivable over one said remote electrode end, in which the other end of said spring is enlarged in diameter to receive the end of the high voltage coil wire of the ignition system, and including a second spring of constant diameter sleeved snugly over the other remote electrode end and insertable into the high voltage socket of the ignition system coil.

* * * * *